US005842568A

United States Patent [19]

Chang-wen et al.

[11] Patent Number: 5,842,568

[45] Date of Patent: Dec. 1, 1998

[54] SAFETY PACKAGE OF THE STRUNG UP ELECTRICAL LIGHTS

[76] Inventors: Chen Chang-wen; Mei-mei Lin; May-sing Tsai, all of Suite 2, 7F, No. 95-8 Chang Ping Road, Sec. 1, Taichung, Taiwan

[21] Appl. No.: 654,152

[22] Filed: May 28, 1996

[51] Int. Cl.[6] ..... B65D 85/42

[52] U.S. Cl. ..... 206/419; 206/485; 206/589

[58] Field of Search ..... 206/418–420, 206/485, 588, 589, 590

[56] References Cited

U.S. PATENT DOCUMENTS

| | | | |
|---|---|---|---|
| 1,981,731 | 11/1934 | Holy | 206/763 |
| 2,872,032 | 2/1959 | West | 206/419 |
| 3,002,609 | 10/1961 | Batkin | 206/419 |
| 3,048,323 | 8/1962 | Stauffer | 206/418 |
| 3,136,410 | 6/1964 | Sanford | 206/419 |
| 3,462,020 | 8/1969 | Hall | 206/419 |

FOREIGN PATENT DOCUMENTS

| | | | |
|---|---|---|---|
| 899824 | 5/1972 | Canada | 206/419 |
| 233152 | 5/1952 | United Kingdom | 206/418 |

*Primary Examiner*—Paul T. Sewell
*Assistant Examiner*—Luan K. Bui

[57] ABSTRACT

A safety package of the strung up electrical lights comprises a first packing member and a second packing member made from carton papers. The first packing member has several rows of circular recesses for sequentially mounting the strung up electrical lights therein and places into a carton box and the second packing member has same rows of smaller circular recesses made in registry with the circular recesses of the first packing member so that the smaller recesses engage the topmost of the respective lights when the second packing member protects the top of the lights.

3 Claims, 5 Drawing Sheets

SAFETY PACKAGE OF THE STRUNG UP ELECTRICAL LIGHTS

BACKGROUND OF THE INVENTION

The present invention relates to package of fragile materials, and more particularly to the safety package of the strung up electrical lights which saves the packing space and prevents the damagement of the electrical lights during transportation.

Typical package of electrical lights is separately packing the electrical bulbs from it's sockets. The bulbs in certain quantity are protected by sleeving a flexible material thereon and regularly arranged in a carton box, or that the bulbs plant in rows in a recessed carton paper and then are packed in a carton box; the sockets either singular or strung up in a string usually loose packed. This kind of package has an advantage of saving the time at the packing stage but makes inconvenience for the users because they have to mount the bulbs to the sockets themselves after buying the lights, especially the strings of lights.

Currently, an improvement has been made for packing the strung up electrical lights as show in FIG. 1, which utilizes a piece of folded up carton paper 10 making a plurality elongate projections 11 parallel and spaced apart to one another. Each of those elongate projections 11 has a predetermined number of semi-circular indentations 12 in regular space in the crown thereof for sequentially securing a string of lights 13 therein. The lights 13 are transversely secured in those indentations and the plugs 14 at the ends of the string are received in the lateral spaces when the folded up carton paper is placed into a carton box 15. This arrangement of package of the strung up electrical lights provides great convenience to the users for their immediate application of the lights but there is disadvantages such as: (a) wastes a lot of space in the carton box especially in the longitudical section, (b) wastes time for pre-mounting the bulbs into the sockets, and (c) the transverse arrangement of the lights into a single indentation is unstable thus causing great damagement during transportation stage.

SUMMARY OF THE PRESENT INVENTION

The main object of the present invention is to provide a safety package of the strung up electrical lights which package provides greater capacity for safety packing more electrical lights at a smaller space.

Another object of the present invention is to provide safety package of the strung up electrical lights which combines the packing process with the mounting process so as to save a lot of time in packing stage.

Still another object of the present invention is to provide a safety package of the strung up electrical lights which package is relatively stable to prevent the lights from damagement during transportation stage.

Further object of the present invention is to provide a safety package of the strung up electrical lights which package is readily unpacking so as to facilitate the users of their convenient application.

The present invention will become more fully understood by reference to the following detailed description thereof when read in conjunction with the attached drawings.

DETAILED DESCRIPTION OF THE PREFERRED EMBODIMENT OF THE PRESENT INVENTION

Figure 1:
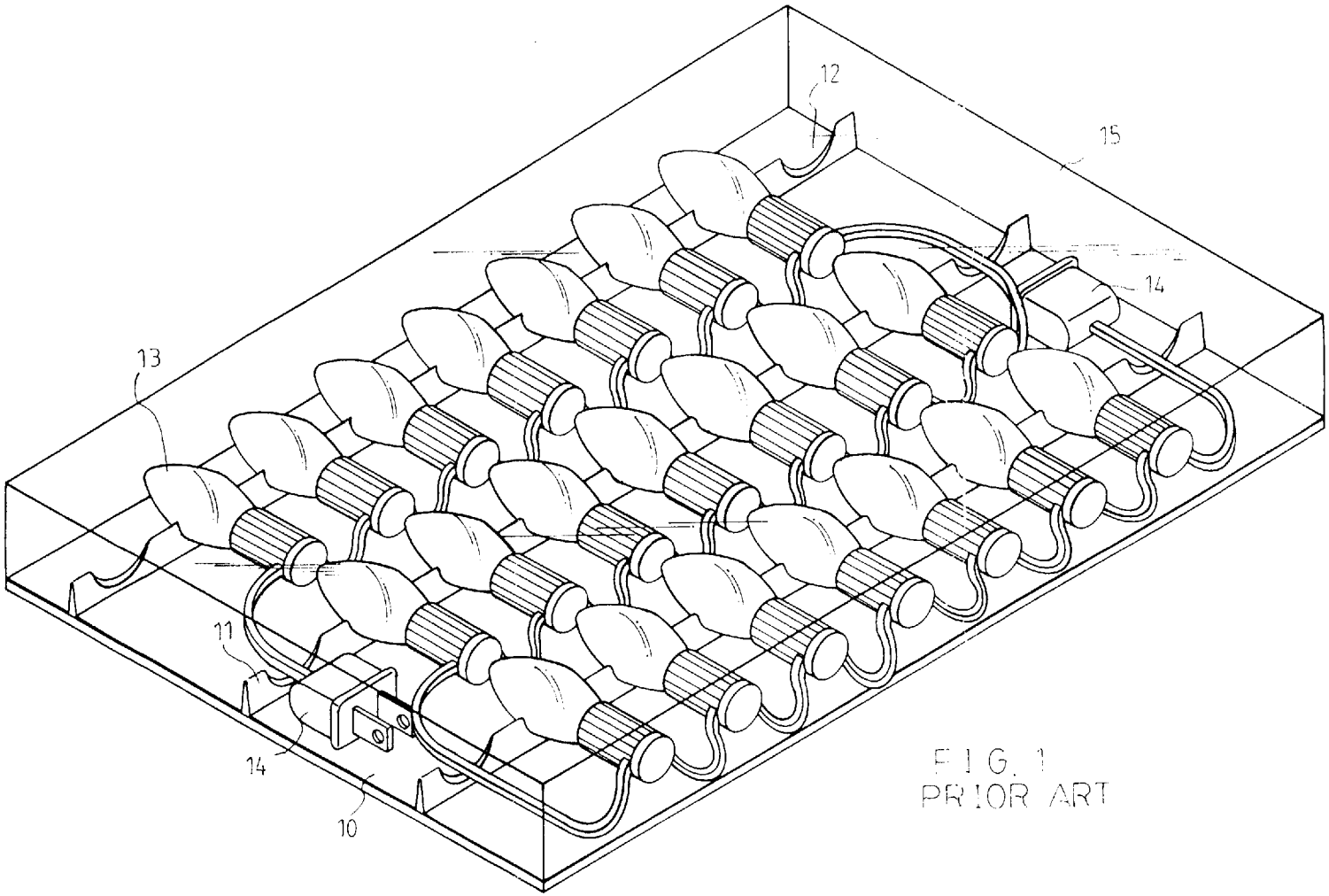
FIG. 1 PRIOR ART
FIG. 1 is a perspective view to show a package of a strung up electrical lights according to a prior art.
Figure 2:
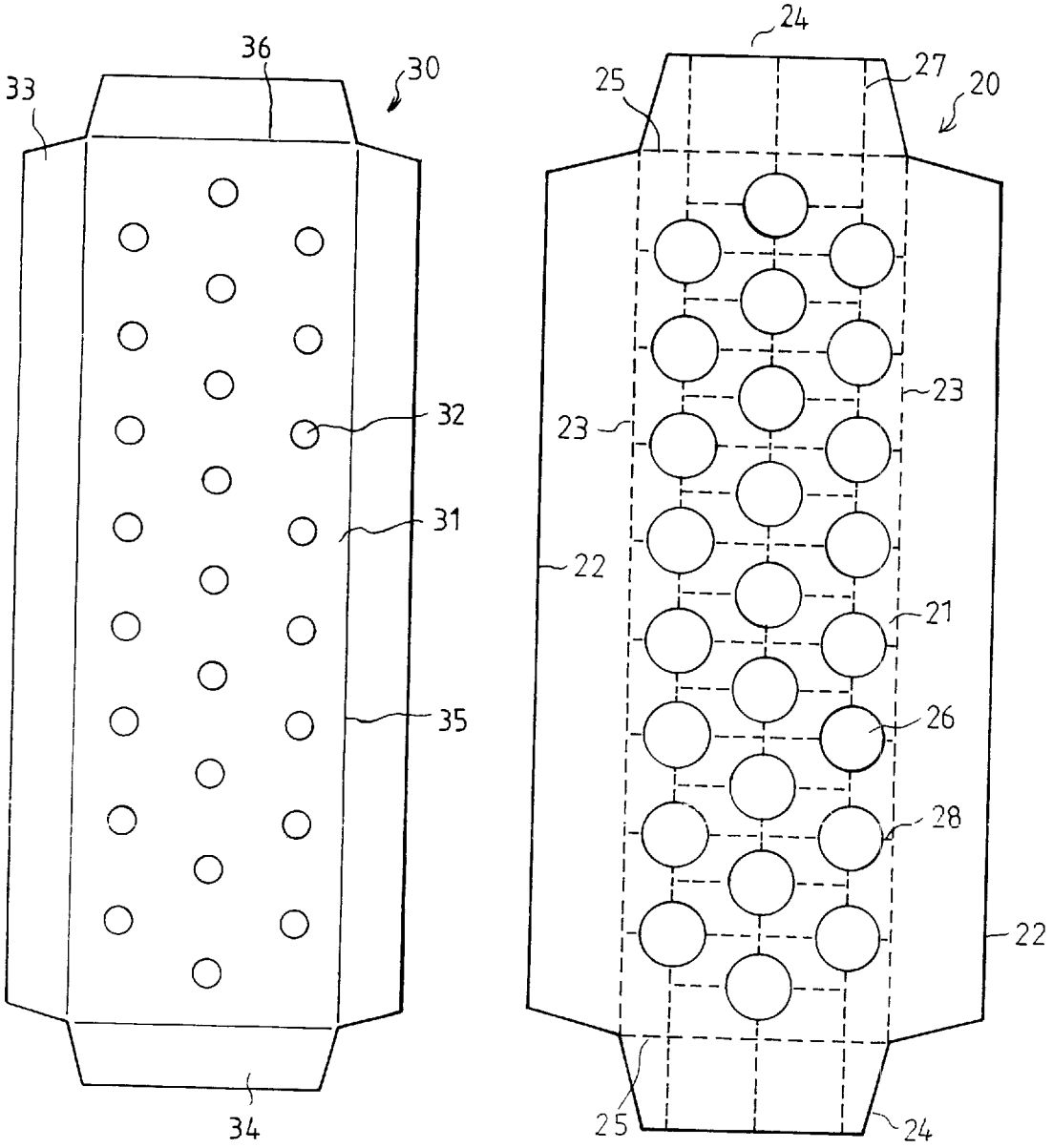
FIG. 2 is a top plane view to show a pair of a first and a second packing members according to the preferred embodiment of the present invention.

With reference to FIG. 2 of the drawings, the safety package of the strung up electrical lights of the present invention comprises generally a first packing member 20 and a second packing member 30 which are made from pieces of cutted up carton papers.

The first packing member 20 has a flat rectangular body 21 of predetermined size, a pair of the first flaps 22 formed along with the lateral sides of the body 21 and divided by a pair of the first perforated folding lines 23, a pair of the second flaps 24 formed along with two ends of the body 21 and divided by a pair of second perforated folding lines 25 therebetween and a plurality of circular recesses 26 in the body 21. The recesses 26 which are of a diameter equal to the diameter of the head of the electrical bulb to be mounted, are aligned into three rows along the longitudinal direction of the body 21 and the recesses 26 between adjacent rows are alternate with each other. Actually, the size of the recesses 26 as well as it's member or rows can be varied to cope with the different requirement of the electrical lights. In this embodiment, the central row contains 9 recesses 26 and two the lateral rows each contains eight recesses 26. A plurality of longitudinal perforated line 27 and a plurality of transversely perforated line 28 are crosswise punched in the body 21 through each recess 26. The perforations in these perforated lines 27 and 28 are smaller than that of perforated lines 23 and 25 but can be tore off when unpacking.

The second packing member 30 which is provided to protect the bulbs of the lights from damagement subjected to the external bumping or vibration, has a flat rectangular body 31 in the size equal to that of the body 21, three rows of small circular recesses 32 which is made in registry with the circular recesses 26 of the first packing member 20 and a pair of lateral flaps 33 and a pair of end flaps 34 which are divided by the a third and a fourth non-perforated folding lines 35 and 36 respectively.

Figure 3:
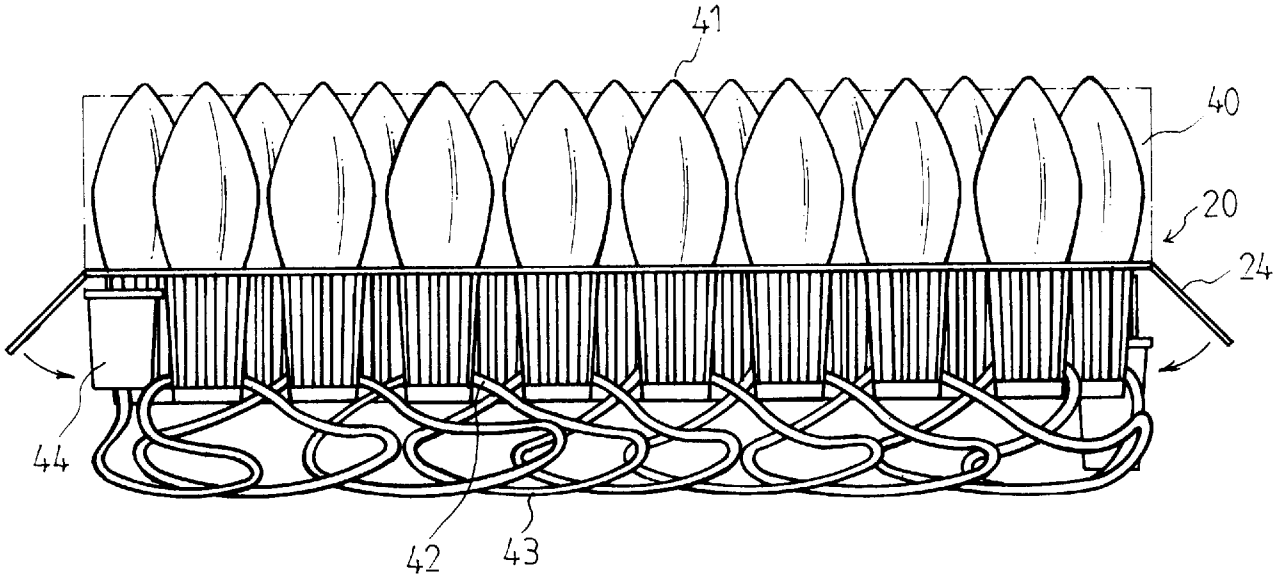
FIG. 3 is a sectional view to show the strung up electrical lights being regularly mounted in the circular recesses of the first packing member.
Figure 4:
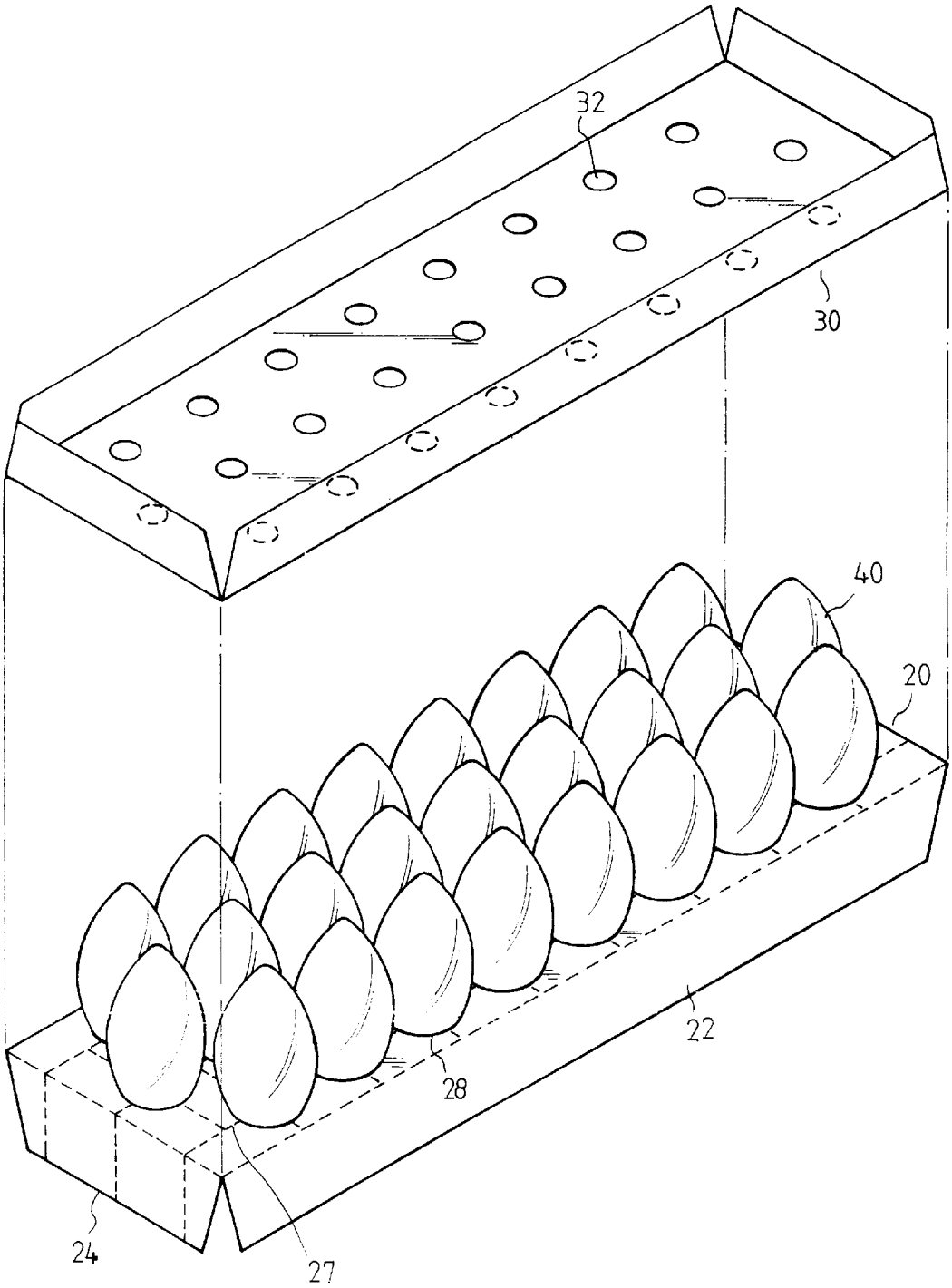
FIG. 4 is a perspective view to show an assembly of the preferred embodiment of the present invention.

Referring to FIG. 3 of a sectional view which shows the strung up lights are sequentially mounted to the recesses 26 of the first packing member 20. Each light 40 comprised of a bulb 41 and a socket 42. The sockets 42 have been strung up by electrical cords 43 which has a pair of plugs 44 connected at two ends. When packing, insert the head of the bulbs 41 on one by one basis into the recesses 26 from the top of the first packing member and sequentially mount the strung up sockets 42 to their respective bulbs 41 and then bend downward the pairs of the flaps 22 and 24 following the perforated folding lines 23 and 25 (as shown in FIG. 4) when the first packing member 20 mounted with the strung up electrical lights 40 is placed into a suitable carton box 50, the cords 43 and the plugs 44 are received in a space under the sockets 42. The second packing member 30 covers the top of the bulbs 41 where the small recesses 32 engage on the topmost of the respective bulbs 41.

Figure 5:
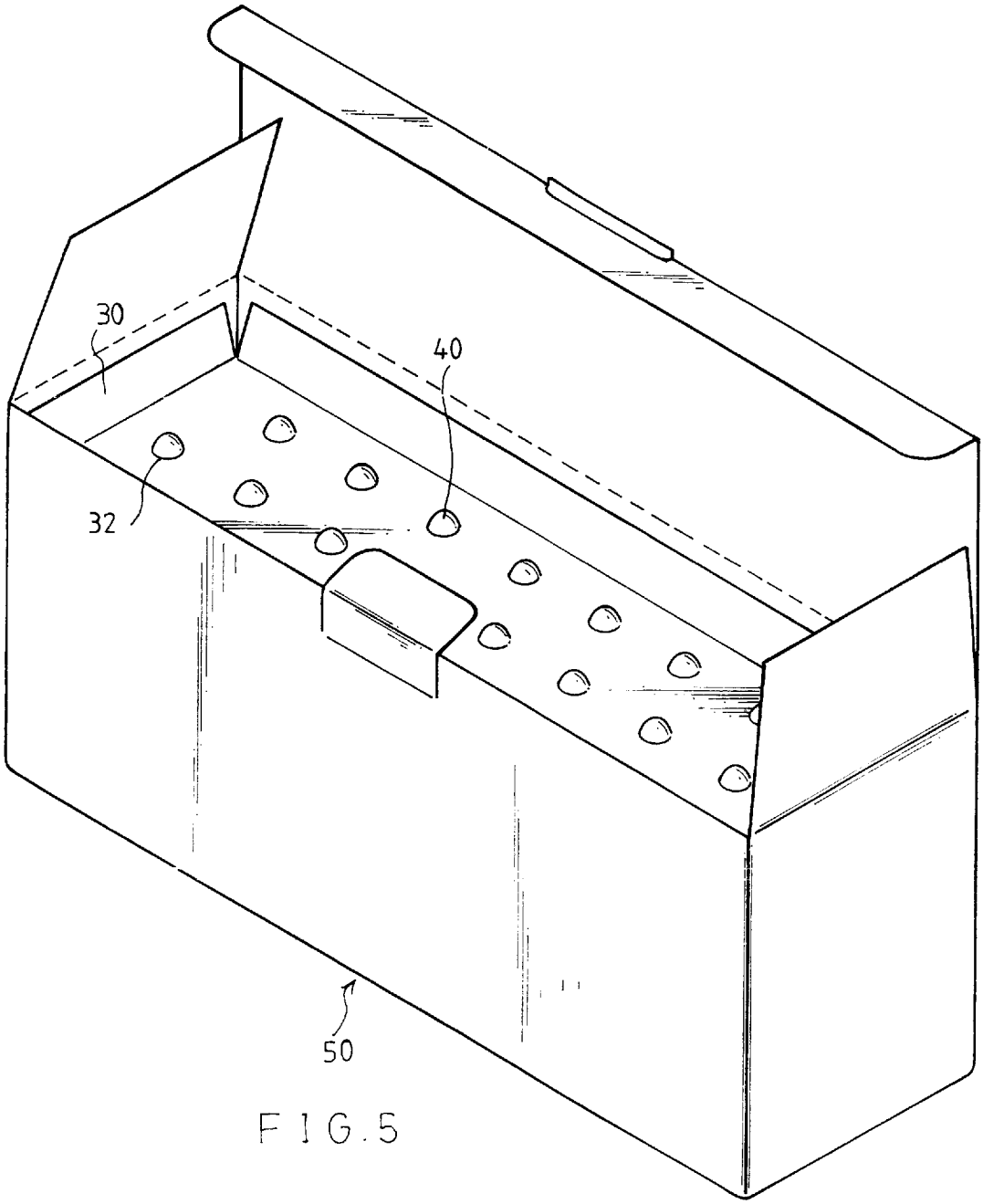
FIG. 5 is a perspective view to show that the well packed electrical lights is received in a suitable carton box.

FIG. 5 shows a string of electrical lights 40 is safely packed in place into a suitable carton box 50 by a first packing member 20 and a second packing member 30.

When unpacking, the user takes the first and second packing members out of the box 50 and tears off the first packing member following either of those perforated lines 23, 25, 27 and 28 or presses the electrical bulbs 41 downward from the upper surface of the first packing member 20 to widen those recesses 26 so that the strung up electrical lights 40 are uniformly unpacked.

Note that the specification relating to the above embodiment should be construed as examplary rather than as limitative of the present invention, with many variations and modifications being readily attainable by a person of average skill in the art without departing from the spirit or scope thereof as defined in the appended claims and their legal equivalent.

I claim:

1. A package comprising a carton box, a first packing member, a second packing member and a string of the electric lights;

said first packing member for mounting said lights having a flat rectangular body, a pair of lateral flaps divided by a pair of first perforated folding lines, a pair of end flaps divided by a pair of second perforated folding lines therebetween and a plurality of circular recesses spacedly punched on said flat rectangular body therethrough, said plurality of circular recesses being aligned into a predetermined member of rows parallel to a longitudinal direction of said flat rectangular body, said each row containing a predetermined number of said recesses, at least a longitudinal perforated line and at least a transverse perforated folding line crosswise punched in said flat rectangular body and through each of said recesses;

said second packing member for protecting the top of said lights having a flat rectangular body sizably equal to that of said first packing member, a plurality of small circular recesses through said body and made in registry with said circular recesses of said first packing member, a pair of lateral flaps divided by a pair of third folding lines and a pair end flaps divided by a pair of fourth folding lines therebetween, said carton box for receiving said first and second packing members and said string of electrical lights therein, includes a rectangular housing having a size made in registry with said first and second packing members.

2. A safety package as recited in claim 1 wherein said first and second packing members are made from carton papers.

3. A safety package as recited in claim 1 wherein said circular recesses between adjacent rows are alternate with each other.

* * * * *